US006861995B2

(12) United States Patent
Kuo et al.

(10) Patent No.: US 6,861,995 B2
(45) Date of Patent: Mar. 1, 2005

(54) SLOT BRACKET ANTENNA

(75) Inventors: Chia-Ming Kuo, Tu-chen (TW); Hsien-Chu Lin, Tu-Chen (TW); Lung-Sheng Tai, Tu-chen (TW); Zhen-Da Hung, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/330,605

(22) Filed: Dec. 26, 2002

(65) Prior Publication Data

US 2004/0108960 A1 Jun. 10, 2004

(30) Foreign Application Priority Data

Dec. 10, 2002 (TW) ..... 91219998 U

(51) Int. Cl.[7] ..... H01Q 13/10

(52) U.S. Cl. ..... 343/767; 343/702

(58) Field of Search ..... 343/702, 767

(56) References Cited

U.S. PATENT DOCUMENTS 5,677,698 A * 10/1997 Snowdon ..... 343/770
6,373,443 B1 4/2002 Tsai et al. ..... 343/702
6,473,043 B1 * 10/2002 Hwang ..... 343/702

* cited by examiner

*Primary Examiner*—James Vannucci

(57) ABSTRACT

A slot bracket antenna (10) for transmitting or receiving signals is installed to cover an extension slot (9) of an electronic device. The slot bracket antenna includes a bracket (2), a slot (1) defined in the bracket, and a coaxial cable (3) attached to the bracket. The bracket comprises an inner core wire (4) and a metal braiding layer (6). The inner core wire and the metal braiding layer are respectively soldered to two sides of the slot in the bracket.

5 Claims, 7 Drawing Sheets

Scale: 5dBi/div
Operating Frequency: 2.5GHz
Horizontally Polarized

Scale: 5dBi/div
Operating Frequency: 2.5GHz
Vertically Polarized

SLOT BRACKET ANTENNA

BACKGROUND OF THE INVENTION

1. Field of the Invention

The present invention relates to an antenna, and in particular to a slot bracket antenna employed in an electronic device.

2. Description of the Prior Art

With current developments in communication technology, such as Wireless Local Area Network (WLAN), Bluetooth and HomeRF, many desktop computers now have the function of wireless telecommunication at close range. To achieve this function, an antenna is used with a desktop computer for receiving and transmitting signals. One conventional antenna used with a WLAN card having a Peripheral Component Interconnect (PCI) interface is externally mounted. The WLAN card is mounted in a PCI expansion slot in a desktop computer with a bracket covering a corresponding slot in a back cover of an enclosure of the desktop computer. The antenna is mounted to an exterior side of the bracket and electrically connects with the WLAN card through the bracket. However, the antenna is exposed to an outside of the enclosure and can be easily damaged, so the performance of the antenna is not really reliable. A second conventional antenna is directly mounted in the enclosure of the desktop computer by soldering or screwing to an inner surface thereof. However, this antenna is inconvenient to assemble or disassemble. Furthermore, another disadvantage of this antenna is that the screwing process defaces the appearance of the enclosure.

Hence, an improved antenna is desired to overcome the above-mentioned shortcomings of existing antennas.

BRIEF SUMMARY OF THE INVENTION

A primary object, therefore, of the present invention is to provide an antenna which is convenient to mount to a computer enclosure, while at the same time being reliably protected from mechanical damage.

A slot bracket antenna in accordance with the present invention for use with an electronic device includes a bracket, a slot defined in the bracket, and a coaxial cable comprising an inner core wire and a metal braiding layer. The inner core wire and the metal braiding layer are respectively soldered to two sides of the slot for transmitting signals. The bracket is installed in an expansion slot of the electronic device.

In contrast to the prior art, the slot is defined directly in the bracket of the present invention. The slot bracket antenna has the advantages of being easy to assemble and low in cost.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
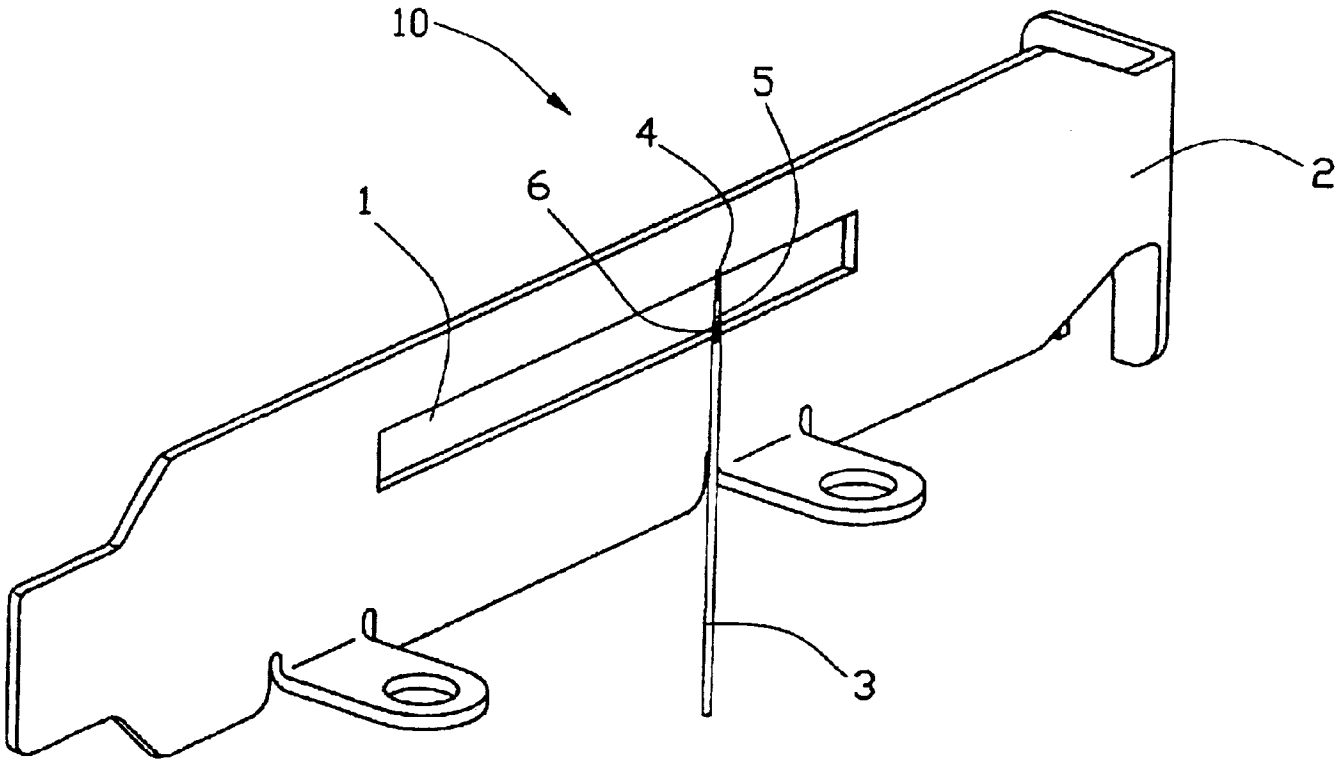
FIG. 1 is a perspective view of an inward side of a slot bracket antenna in accordance with a first embodiment of the present invention.
Figure 4:
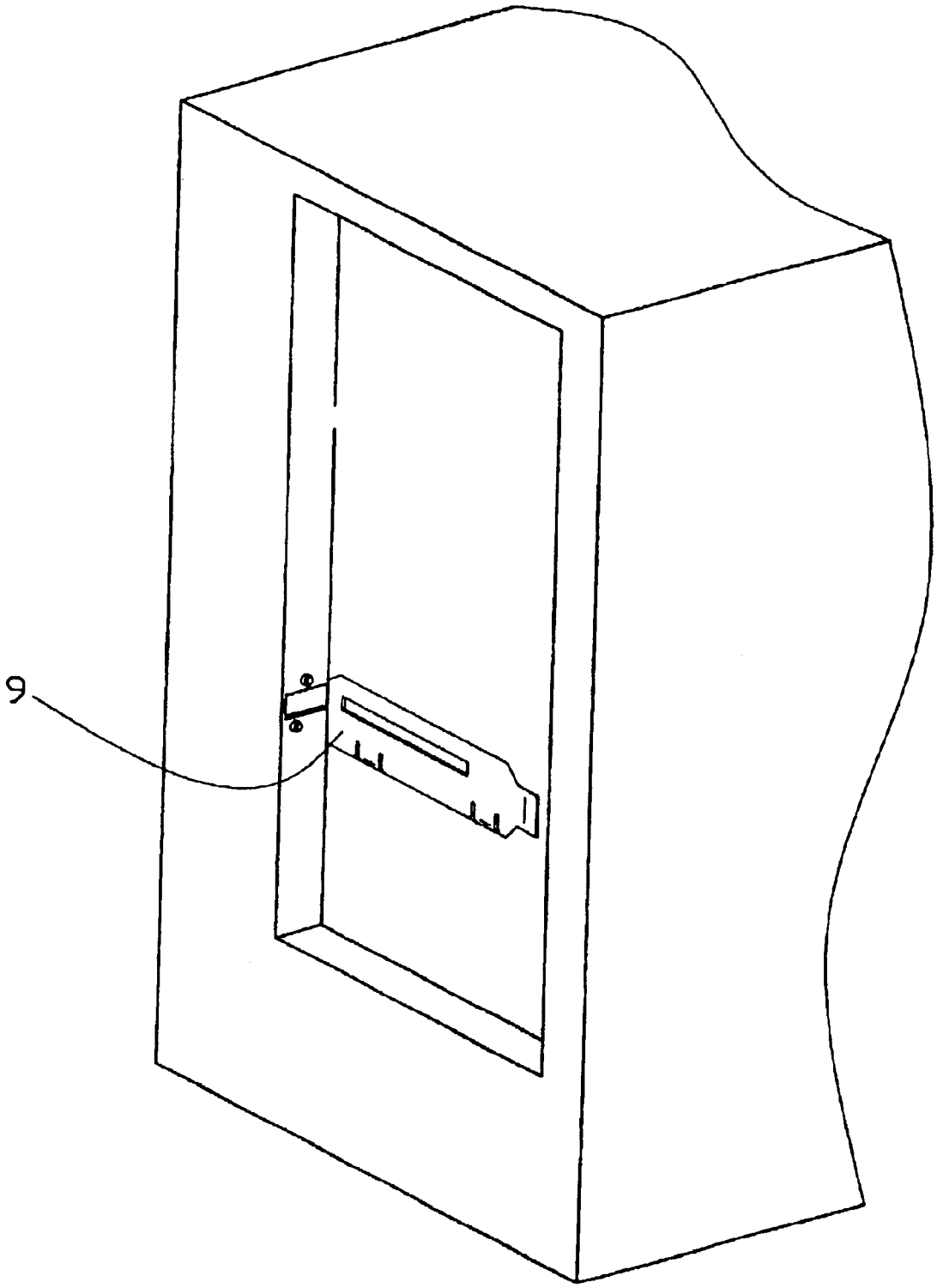
FIG. 4 is a view of the slot bracket antenna of FIG. 1 installed in an expansion slot of a computer.

Referring to FIGS. 1 and 4, a slot bracket antenna 10 in accordance with a first embodiment of the present invention is designed for installation on a shell of a computer (not labeled) and comprises a bracket 2, a slot 1 defined in the bracket 2 and a coaxial cable 3. The coaxial cable 3 comprises an inner core wire 4, an insulation layer 5 and a metal braiding layer 6. The inner core wire 4 and the braiding layer 6 are respectively soldered to two sides of the slot 1, on a side of the bracket 2 which is inward toward the computer when the bracket 2 is mounted on the computer.

Figure 2:
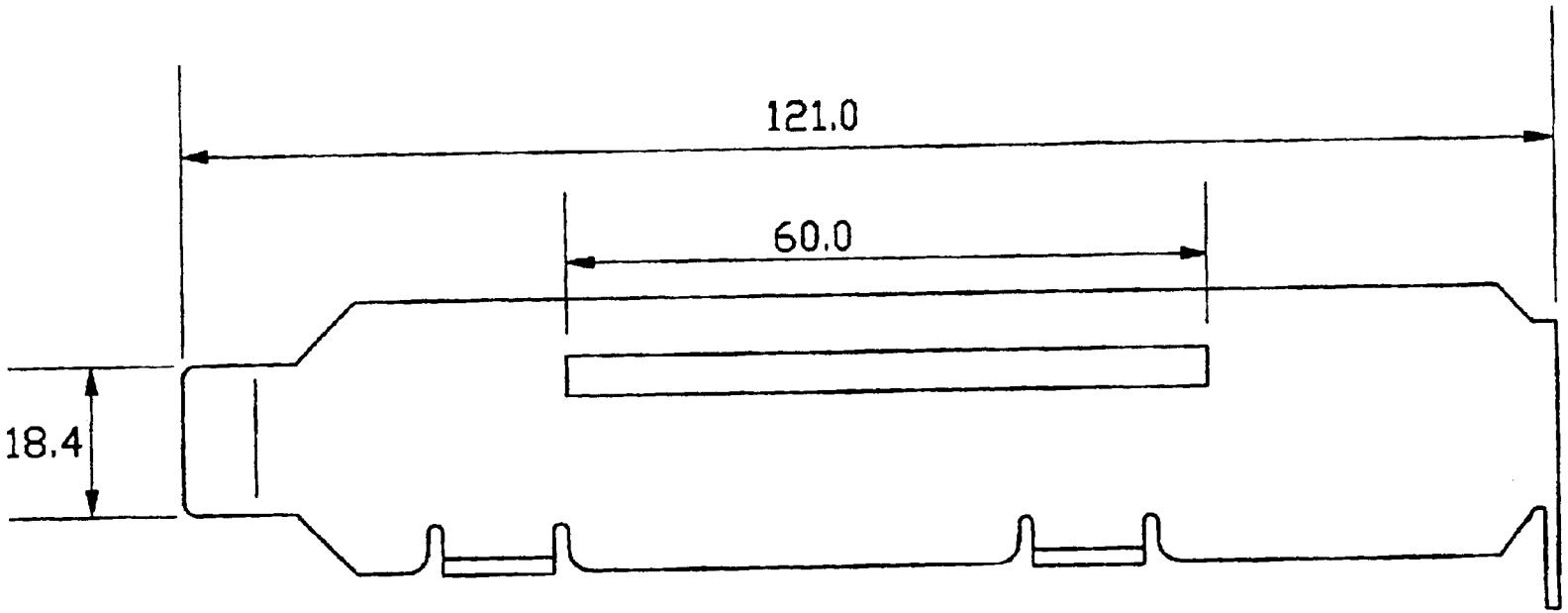
FIG. 2 is a view of the slot bracket antenna of FIG. 1 illustrating some dimensions of the slot bracket antenna.

Referring to FIG. 2, major dimensions of the slot bracket antenna are labeled, wherein all dimensions are measured in millimeters (mm).

Figure 3:
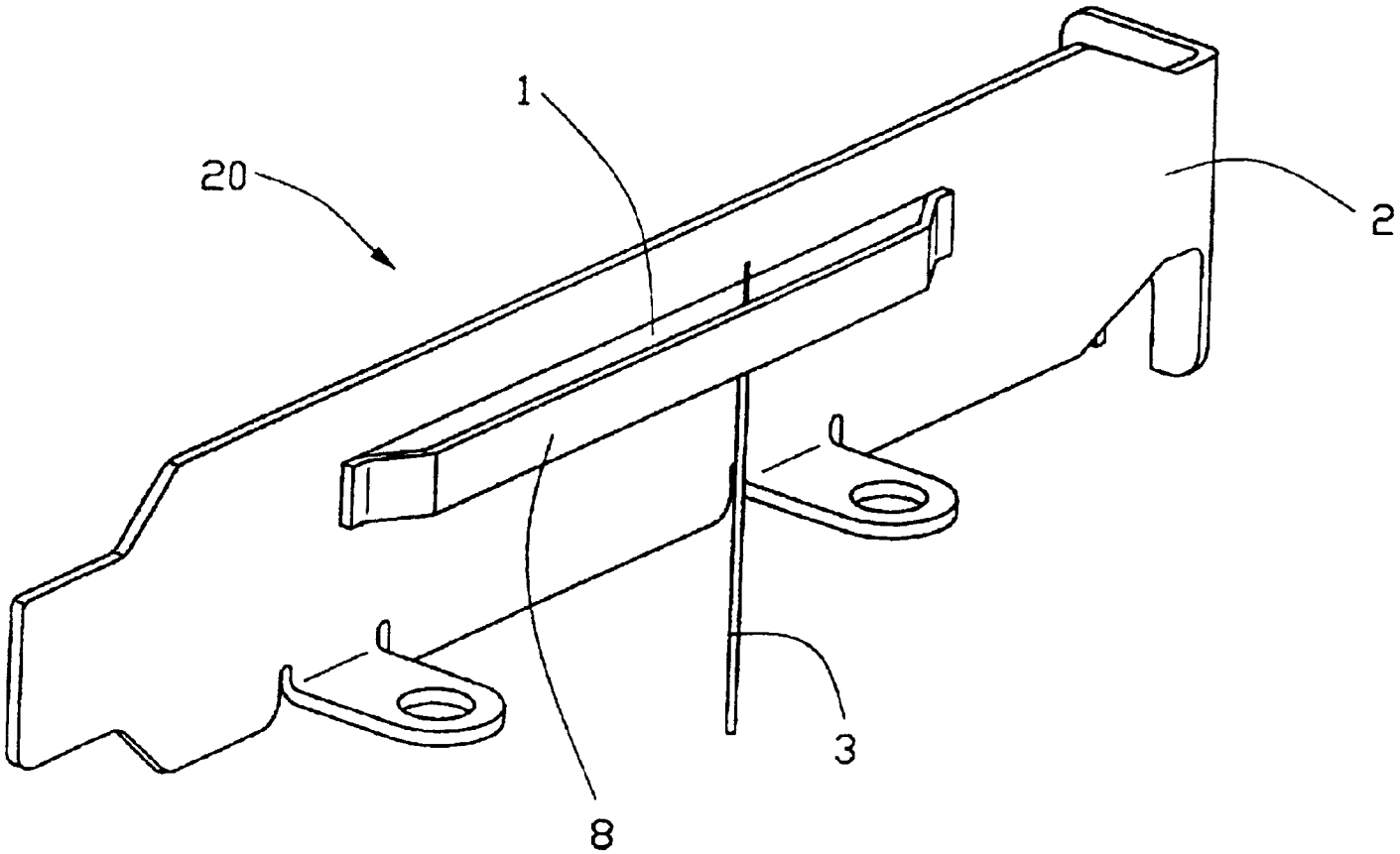
FIG. 3 is a perspective view of an inward side of a slot bracket antenna of a second embodiment similar to the first embodiment shown in FIG. 1, but having a metal shielding cover.

Referring to FIG. 3, a slot bracket antenna 20 of a second embodiment is identical to that of the first embodiment but further includes a metal shielding cover 8. The metal shielding cover 8 covers the slot 1 and is on a same inward side of the bracket 2 to which the coaxial cable 3 is soldered. The reflection provided by the metal shielding cover 8 results in more antenna gain, while at the same time curtailing electromagnetic interference (EMI) transmission through the bracket 2, thus protecting the components inside the computer from EMI in the environment outside the shell of the computer, and protecting the external environment from EMI emission from inside the computer.

Referring to FIG. 4, the bracket 2 is installed in an expansion slot 9 of a shell of a computer. The metal shielding cover 8 and the coaxial cable 3 are inside the shell.

Figure 5:
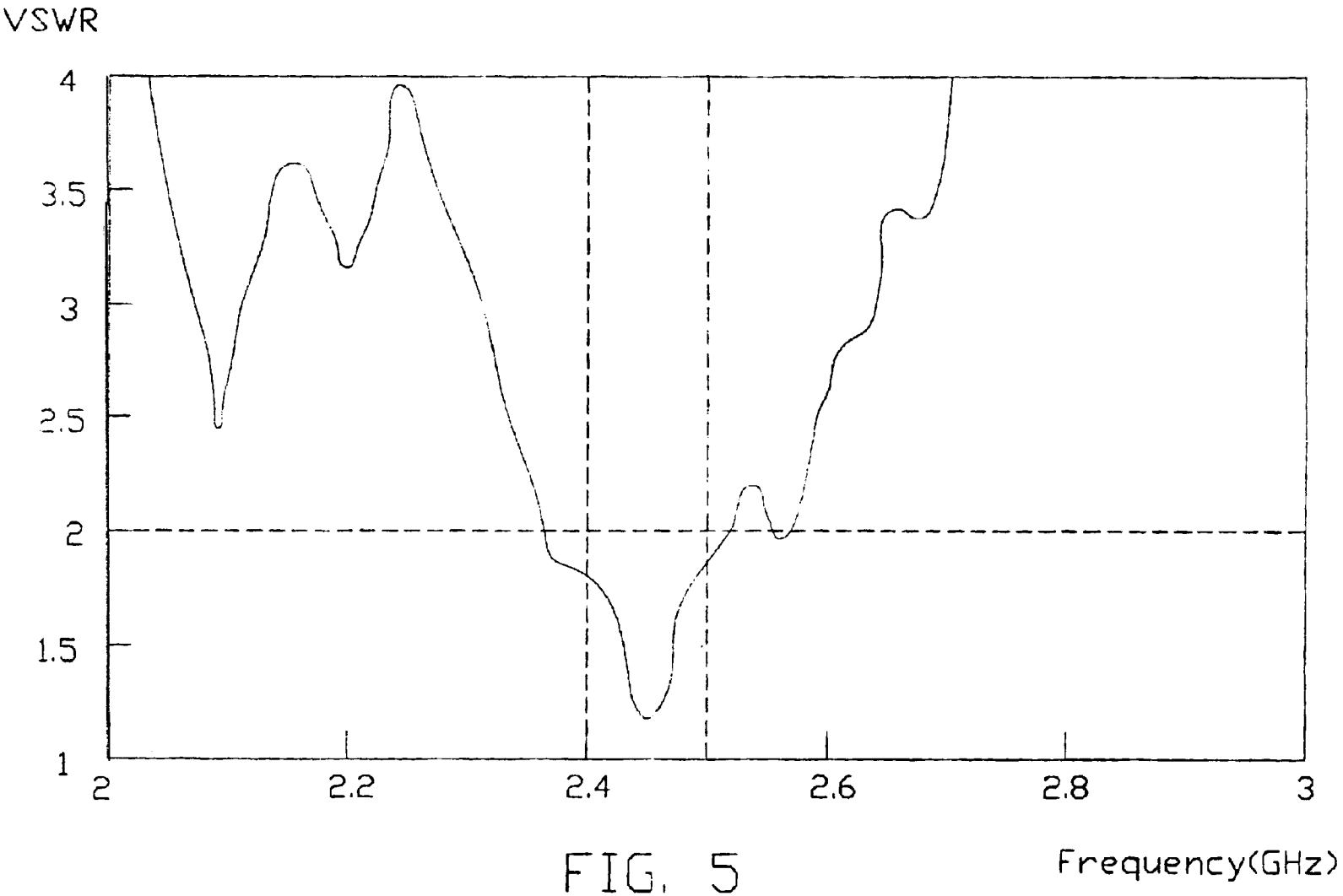
FIG. 5 is a test chart recording for the slot bracket antenna of FIG. 3, showing Voltage Standing Wave Ratio (VSWR) as a function of frequency.

FIG. 5 shows a test chart recording of Voltage Standing Wave Ratio (VSWR) of the second embodiment slot bracket antenna 20 as a function of frequency. Note that VSWR drops below the desirable minimum value "2" in the 2.4–2.5 GHz frequency band, indicating acceptably efficient operation in this frequency band.

Figure 6:
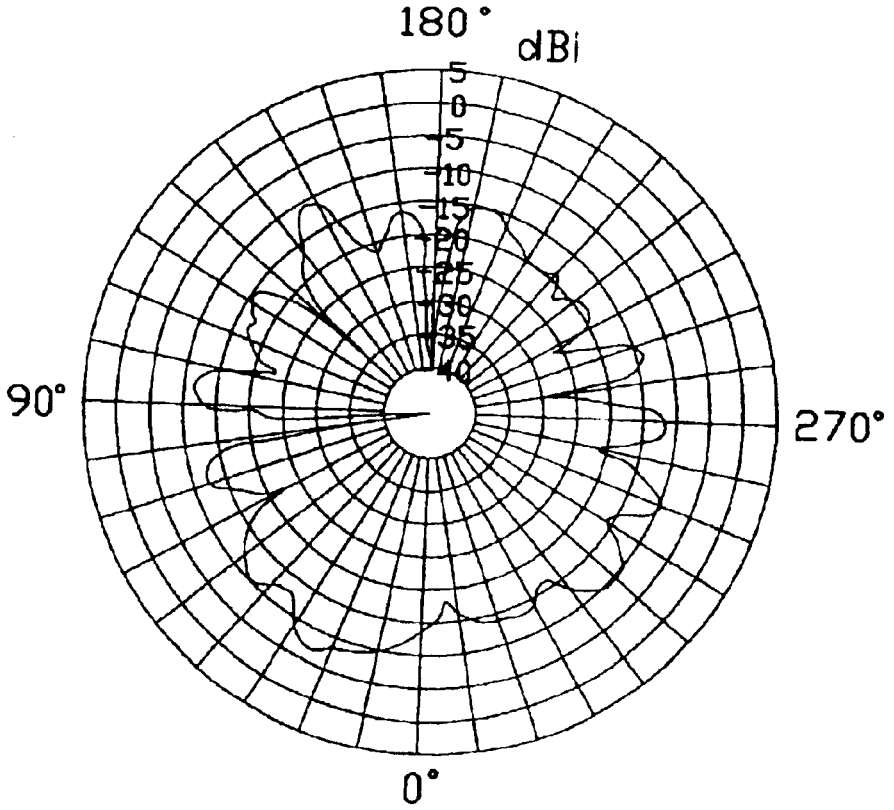
FIG. 6 is a recording of a horizontally polarized principle plane radiation pattern of the slot bracket antenna of FIG. 3 operating at a frequency of 2.5 GHz.
Figure 7:
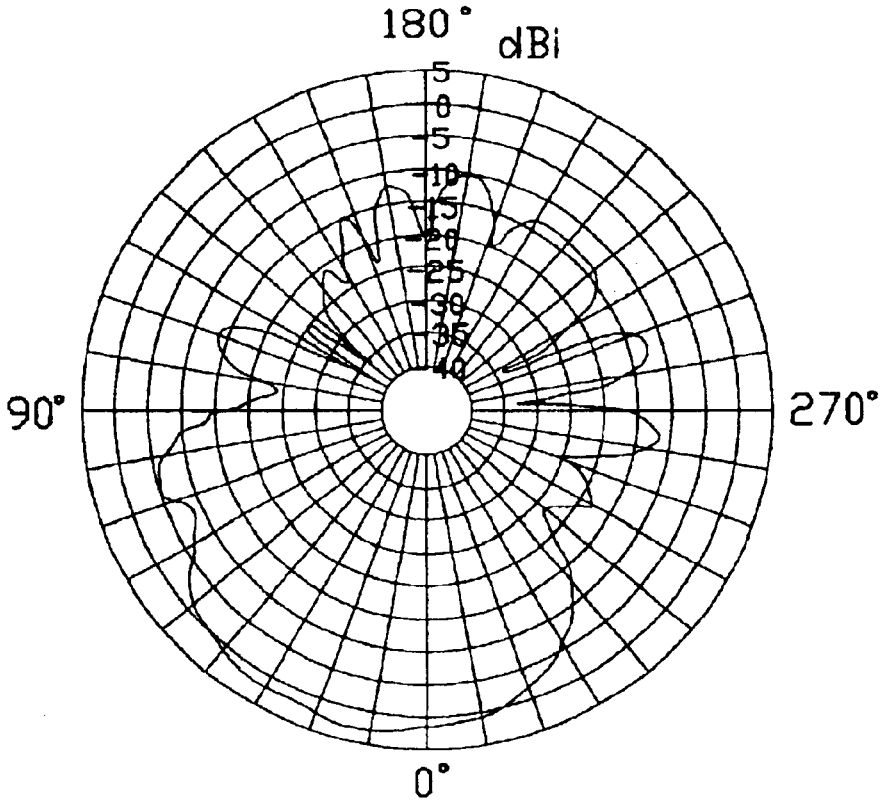
FIG. 7 is a recording of a vertically polarized principle plane radiation pattern of the slot bracket antenna of FIG. 3 operating at a frequency of 2.5 GHz.

FIGS. 6–7 respectively show horizontally and vertically polarized principle plane radiation patterns of the second embodiment slot bracket antenna 20 operating at frequencies of 2.5 GHz. Note that each radiation pattern is close to a corresponding optimal radiation pattern and there is no obvious radiating blind area.

The slot bracket antenna 10, 20 is convenient to mount on a computer enclosure and is also well protected from mechanical damage inflicted by the outside environment. Furthermore, the configuration of the slot 1 in the slot bracket antenna can be changed to create a duel-band antenna.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A slot bracket antenna for installation over an expansion slot of an electronic device, comprising:

a metal bracket having a slot defined therein;

a coaxial feeder cable comprising a metal braiding layer and an inner core wire respectively and electrically connecting with two sides of the slot; and a metal shielding cover covering the slot;

wherein the bracket is installed in and covers an expansion slot of the electronic apparatus.

2. The slot bracket antenna as claimed in claim 1, wherein the metal shielding cover and the coaxial cable are both on a same side of the bracket, inward of the electronic apparatus.

3. An electronic device, comprising:

a shell, having at least one expansion slot defined therein;

a slot bracket antenna, comprising:

a metal bracket, arranged to cover one of the at least one expansion slot of the shell;

a slot being defined in the bracket; and a coaxial feeder cable comprising a metal braiding layer and an inner core wire respectively and electrically connecting with two sides of the slot; and a metal shielding cover covering the slot.

4. The electronic device as claimed in claim 3, wherein the metal shielding cover and the coaxial cable are in a same, inward side of the bracket, both being disposed in the electronic device.

5. A computer enclosure comprising:

a back panel defining therein an expansion slot along a lengthwise direction;

a metal bracket attached to the back panel and covering said expansion slot;

a slot formed in said bracket and extending along said lengthwise direction; and a feeder cable extending in a transverse direction perpendicular to said lengthwise direction, and including an outer braiding fixed at a first position on one side of said slot, and and inner conductor extending along said transverse direction across the slot and fixed to a second position on the other side of said slot;

wherein said inner conductor and said outer braiding are attached to an inner surface of said bracket while a cable portion between said first and second positions is exposed to an exterior via said slot in a front-to-back direction perpendicular to said lengthwise and transverse directions;

wherein a metallic shielding core with a similar dimension as the slot, is formed behind the bracket, and cooperates with said bracket to sandwich said cable portion therebetween.

* * * * *